US010386161B1

(12) United States Patent
Snell et al.

(10) Patent No.: US 10,386,161 B1
(45) **Date of Patent: *Aug. 20, 2019**

(54) TARGET WITH SPLATTER PACK

(71) Applicant: Triumph Systems, Inc., St. Louis, MO (US)

(72) Inventors: Justin Taylor Snell, St. Louis, MO (US); Kenneth William Harris, St. Louis, MO (US); Aaron Paul Brookhart, St. Louis, MO (US); Eric Maniquis Sia, Ballwin, MO (US); Jared Wallace Ogden, II, St. Louis, MO (US); Brandon Thomas Hefer, St. Louis, MO (US)

(73) Assignee: Stiumph Systems, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/965,950

(22) Filed: Apr. 29, 2018

Related U.S. Application Data

(63) Continuation-in-part of application No. 15/224,527, filed on Jul. 30, 2016, now Pat. No. 9,958,239.

(60) Provisional application No. 62/198,701, filed on Jul. 30, 2015, provisional application No. 62/198,721, filed on Jul. 30, 2015.

(51) Int. Cl.
*F41J 5/24* (2006.01)
*F41J 5/22* (2006.01)

(52) U.S. Cl.
CPC .. *F41J 5/22* (2013.01); *F41J 5/24* (2013.01)

(58) Field of Classification Search
CPC ..... F41J 5/20–26
USPC ..... 273/378–380, 383–389
See application file for complete search history.

(56) References Cited

U.S. PATENT DOCUMENTS

| | | | | | |
|---|---|---|---|---|---|
| 3,330,561 | A * | 7/1967 | Kandel | F41J 5/00 | 273/378 |
| 3,353,827 | A * | 11/1967 | Dun, Jr. | F41J 1/00 | 273/378 |
| 3,486,752 | A * | 12/1969 | Colvin | F41J 1/00 | 273/378 |
| 4,203,600 | A * | 5/1980 | Brown | F41J 1/00 | 273/407 |
| 4,243,228 | A | 1/1981 | Marcella | | |
| 4,462,598 | A | 7/1984 | Chalin et al. | | |
| 4,781,595 | A * | 11/1988 | Cox | A63F 3/0685 | 434/328 |

(Continued)

*Primary Examiner* — Mark S Graham
(74) *Attorney, Agent, or Firm* — Creativenture Law, LLC; Dennis JM Donahue, III; Kevin Staed

(57) ABSTRACT

A target system has a splatter pack attached to a target panel. The splatter pack acts as a receptacle for a fluid that provides visual confirmation that the target has been hit as the pack bursts upon impact by a projectile. The splatter pack is formed by an array of chambers that are arranged in a staggered pattern. As the pack bursts, the fluid explodes out and leaves a splatter pattern on or about the target panel. The burst and residual splatter allow the marksman to see whether or not an accurate shot was delivered without having to closely examine the target. The splatter pack is removably secured to the target panel by one or more fasteners. Each one of the chambers in the interior portion of the splatter pack are intersected by at least one of the channels that are formed between adjacent chambers.

22 Claims, 13 Drawing Sheets

(56) References Cited

U.S. PATENT DOCUMENTS

| | | | | | |
|---|---|---|---|---|---|
| 4,921,256 | A * | 5/1990 | Gearhart | F41J 1/01 | 273/378 |
| 5,188,371 | A * | 2/1993 | Edwards | F41J 1/01 | 273/378 |
| 5,197,743 | A * | 3/1993 | Hanson, Jr. | F41J 3/0071 | 273/348 |
| D370,972 | S * | 6/1996 | Dutton | D22/125 | |
| 5,593,162 | A * | 1/1997 | Minuskin | F41J 1/00 | 273/403 |
| 6,575,469 | B2 * | 6/2003 | Love | F41J 1/00 | 273/403 |
| 6,966,557 | B2 * | 11/2005 | Kirk | A63F 9/0243 | 273/349 |
| 7,455,298 | B1 * | 11/2008 | Nettle | F41J 3/0004 | 273/403 |
| 8,556,268 | B2 * | 10/2013 | Su | F41J 1/01 | 273/378 |
| 8,596,643 | B1 * | 12/2013 | Edwards | F41J 5/00 | 273/378 |
| 8,814,167 | B2 | 8/2014 | Davis, Jr. | | |
| 9,494,391 | B1 | 11/2016 | Broadbent | | |
| 9,958,239 | B1 * | 5/2018 | Snell | F41J 5/24 | |
| 2011/0316234 | A1 * | 12/2011 | Miller, Sr. | F41J 5/24 | 273/380 |
| 2013/0009364 | A1 * | 1/2013 | Forness | F41J 5/24 | 273/383 |
| 2013/0270773 | A1 * | 10/2013 | Johnson | F41J 5/24 | 273/408 |
| 2014/0175746 | A1 * | 6/2014 | Fife | F41J 5/20 | 273/378 |

* cited by examiner 12f
52
74
72
44
18'
18''

44'

TARGET WITH SPLATTER PACK

CROSS-REFERENCE TO RELATED APPLICATIONS

This application is a continuation-in-part of U.S. patent application Ser. No. 15/224,527 filed on Jul. 30, 2016 which claims priority to U.S. Provisional Patent Application Nos. 62/198,701 and 62/198,721, both of which had been filed on Jul. 30, 2015 and all of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a shooting target for use with firearms, archery and other projectiles that discharges fluid when punctured by a projectile.

Related Art

Target practice is a method that is used to increase marksmanship. By using targets, a marksman can improve their accuracy and precision in a controlled environment. One commonly used target is a two-dimensional sheet of paper, or other inexpensive material, having a printed pattern of concentric circles surrounding a bullseye or depicting a human or other mammal silhouette. Although relatively cheap and readily available, issues arise as it is difficult to see where projectiles hit a paper target without an up close examination. Marksmen typically attach the target to a backstop and deliver multiple shots before returning to see where their shots have hit. This practice neither provides immediate results nor readily encourages a shooter to alter shots based on where previous shots were delivered. Other marksmen may shoot with a spotter who views the target through binoculars, or other sighting means, and informs the shooter of their shot placement. However, this technique requires an additional person and heavily relies on the spotter's ability to relay accurate information.

To aid marksman in viewing, shooting ranges often have a mechanism that moves these paper targets from a position down range to a viewing position close to the shooter. Unfortunately, this practice still prevents a marksman from seeing immediate results as the marksman is only able to see their performance when the target is moved from the down range position. In the interest of time, most marksmen will deliver a number of shots and only then inspect the target. Such a practice does not allow a marksman to effectively alter their aim between each shot as they do not have a clear indication of where previous shots were placed. Further, these systems are typically only available to those practicing at gun ranges or other places that have installed such a system.

To help marksmen visually recognize when a target has been hit without the aid of a telescopic aid, targets have been formed with bursting containers such as disclosed in U.S. Pat. Nos. 3,330,561 and 4,243,228 or with different colored layers such as disclosed in U.S. Pat. No. 5,188,371. For colored layers which do not need to contain any fluid or other material, the '371 Patent discloses a primary target label that is removably attached to the target base and also discloses replacing the primary target label with a new primary target label that can be placed onto the target base after removing the old primary target label or that can be placed over the primary target label. However, since the bursting container targets which seal solids and/or fluids within an envelope, pocket, or other container use the target's base sheet or back sheet as the back side of the container, there has not been any way to remove and replace burst containers with new containers. According to the teaching of the '371 Patent, the entire used primary target label is replaced with a new primary target label on the target base. However, this replacement cannot be done with the bursting container targets because the containers are integrally formed with the target's base sheet/back sheet and there has not been a solution which would allow for replacement containers. Therefore, there remains a need for a new type of burst containers which can be attached to and removed from a target base and replaced with new containers that are attached either directly to the target base directly or over the burst containers.

Three dimensional targets are also available but are often expensive and lack the features and functionality necessary to quickly refurbish and reuse the vital areas of the targets that is often desired by users. The shell of three dimensional targets are typically formed in the shape of game animals, and although these targets are more realistic, they are more expensive and less mobile than two-dimensional targets so the longevity of the target and ability to remove and replace vital areas on the target are important. To allow for the replacement of the vital areas of targets, U.S. Pat. No. 6,575,469 has removable inserts with vital areas thereon, but these inserts are bulky so they are not readily transportable, and they cannot be used with two-dimensional targets. It would be beneficial to have a target system in which replaceable vital areas are not only readily replaceable but can be more easily transported and used with two-dimensional targets or three dimensional targets.

Another type of three-dimensional target disclosed by U.S. Pat. No. 8,814,167 uses a number of fluid carriers and filler material within the interior cavity of the target. Since the fluid carriers are placed on the backside of the target shell, within the cavity, the filler material not only holds the fluid carriers, the filler material also pushes the fluid out the front of the target shell when a projectile is shot through the shell and the fluid carrier. The fluid carriers are not readily accessible or replaceable nor are they able to be used with two-dimensional targets because the filler material is required to hold the fluid carriers against the backside of the shell. It would be beneficial to have a target system in which fluid chambers are accessible and readily replaceable and can be more easily transported and used with two-dimensional targets or three-dimensional targets without needing filler material around the exterior of chambers.

Intricate target systems provide a more realistic shooting simulation but are typically too expensive for regular use by most marksman and are not transportable. Even in these intricate target systems, they do not provide marksmen with a readily apparent visual indication that a target has been hit from distances which are beneficial for training purposes. Most marksmen are limited affordable and readily available targets, and current realistic target systems can limit the distances for training and can create training scars, or improper habits. Accordingly, it would be beneficial to provide targets that are realistic, durable, and transportable and are also affordable. It would be even more beneficial to have improved aspects of these affordable targets that can be incorporated into the intricate target systems to provide marksmen with readily apparent visual indication that a target has been hit.

SUMMARY OF THE INVENTION

Embodiments of the present invention are comprised of a target system with a target panel and a fluid filled receptacle ("splatter pack"). The splatter pack acts as a receptacle for a fluid that may be a fluorescent or otherwise bright liquid or gel which provides visual confirmation that the target has been hit as the packet bursts upon impact from a projectile. Additionally the fluid may contain or be replaced with various additives including, but not limited to, a gas, sparkles, confetti, glitter, rice, sand, and/or free floating or suspended fibers having a reflective quality. As the pack bursts, the fluid explodes out and leaves a splatter pattern on or about the target panel. The burst and residual splatter allow the marksman to see whether or not an accurate shot was delivered without having to closely examine the target. The splatter pack is removably secured to the target panel by an adhesive and once a pack has burst another can be readily attached in its place. If only a portion of the splatter pack has been hit and not all chambers have burst, individual chambers may be inserted in place of the previously burst chambers.

In one aspect of the invention, the target panel to which the splatter pack is attached may be a number of embodiments. In some embodiments the target panel may be a flat wall or flat target while in others it may be a manikin or other three dimensional structure or simulated mammal like a deer, bear, elk, or other large game animal.

In another aspect of the invention, the splatter pack itself is interiorly separated by a plurality of individual chambers. In one embodiment the splatter pack fluid is segregated by interior walls forming a plurality of individual chambers in a number of shapes including serpentine chambers, horizontal chambers, honeycombed chambers, vertical chambers, or other chamber variations. In another embodiment the chambers are created by a seam connecting the splatter pack's back side and front side and may take any number of shapes, including those described herein.

The splatter pack in another embodiment may be comprised of individual chambers independently affixed to the target panel. Although the individual chambers of this embodiment are not physically attached about their perimeter, they are affixed adjacent to one another and collectively define the splatter pack on the target panel. This embodiment promotes easier replacement of individually burst packs while maintaining the functionality and inventiveness of the present invention as a whole. Additionally, the individuality of the chambers allow a marksman to arrange this embodiment into any pattern they wish, including making the target area smaller or larger than the predetermined sizes of other embodiments.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings which are described in the detailed description below.

DETAILED DESCRIPTION OF THE PREFERRED EMBODIMENTS

Figure 1B:
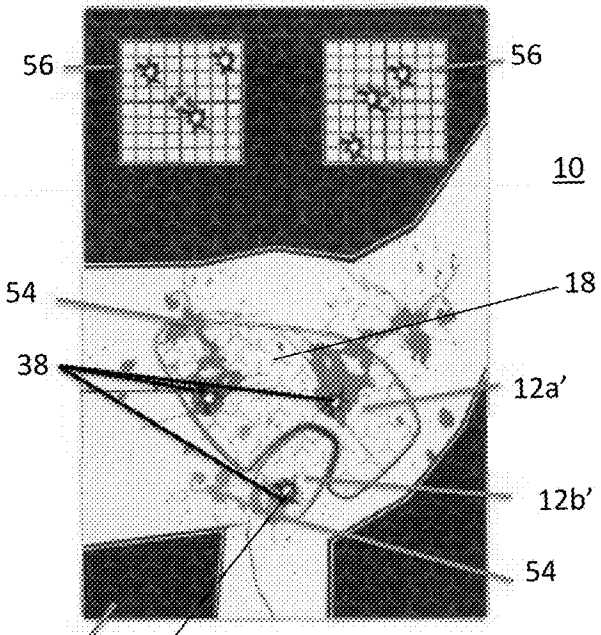
FIGS. 1A and 1B show front views of a target panel having indicia depicting a deer body and splatter packs in the shape of a deer's vital organs, before and after being hit with a projectile.

The following description of the preferred embodiment(s) is merely exemplary in nature and is in no way intended to limit the invention, its application, or uses.

As generally shown in FIGS. 1A, 1B, 2A, 2B, 3, 4A-4C, 5A, 5B, 6D, 7D, 8D, 8E, 9A, and 9B, the splatter pack target 10 has a target panel 100 with one or more splatter packs 12 which contain a fluid 14 sealed within one or more receptacle chambers 18. An adhesive layer 16 is preferably used to attach the splatter packs 12 to the front surface 20 of the target panel 100. As explained with reference to the various embodiments, the splatter packs may be attached to the target with other fasteners and other connection means either in combination with the adhesive layer or without any adhesive layer. As particularly shown in FIGS. 6A, 7A, and 8A, fluid boluses 14*a*, 14*b* are dispensed into the interior space 24 of the chambers 18. A back ply 30 extends entirely across and is attached to the backside of the splatter pack 12 to seal the fluid 14 within the interior space 24. Preferably, the chambers are formed into the front ply 32, and the back ply seals the fluid within the interior space. It will also be appreciated that the chambers could be formed in the back ply. In the various embodiments disclosed herein, the chamber 18 may be referred to as a receptacle or a container.

Figure 1A:
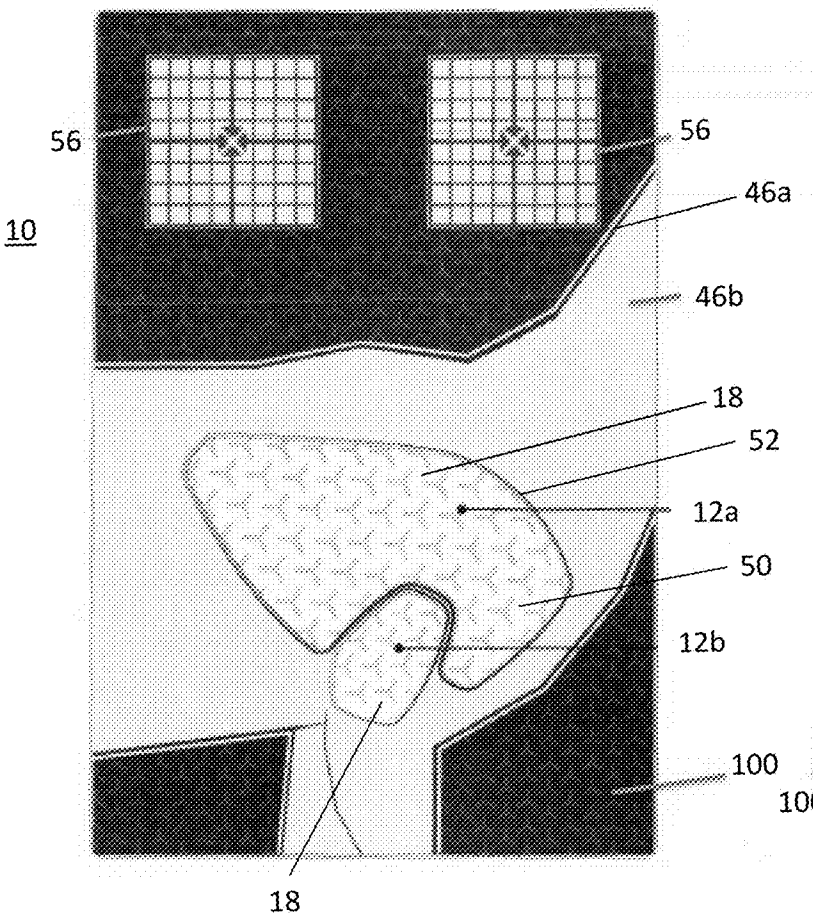
Figures 2A, 2B:
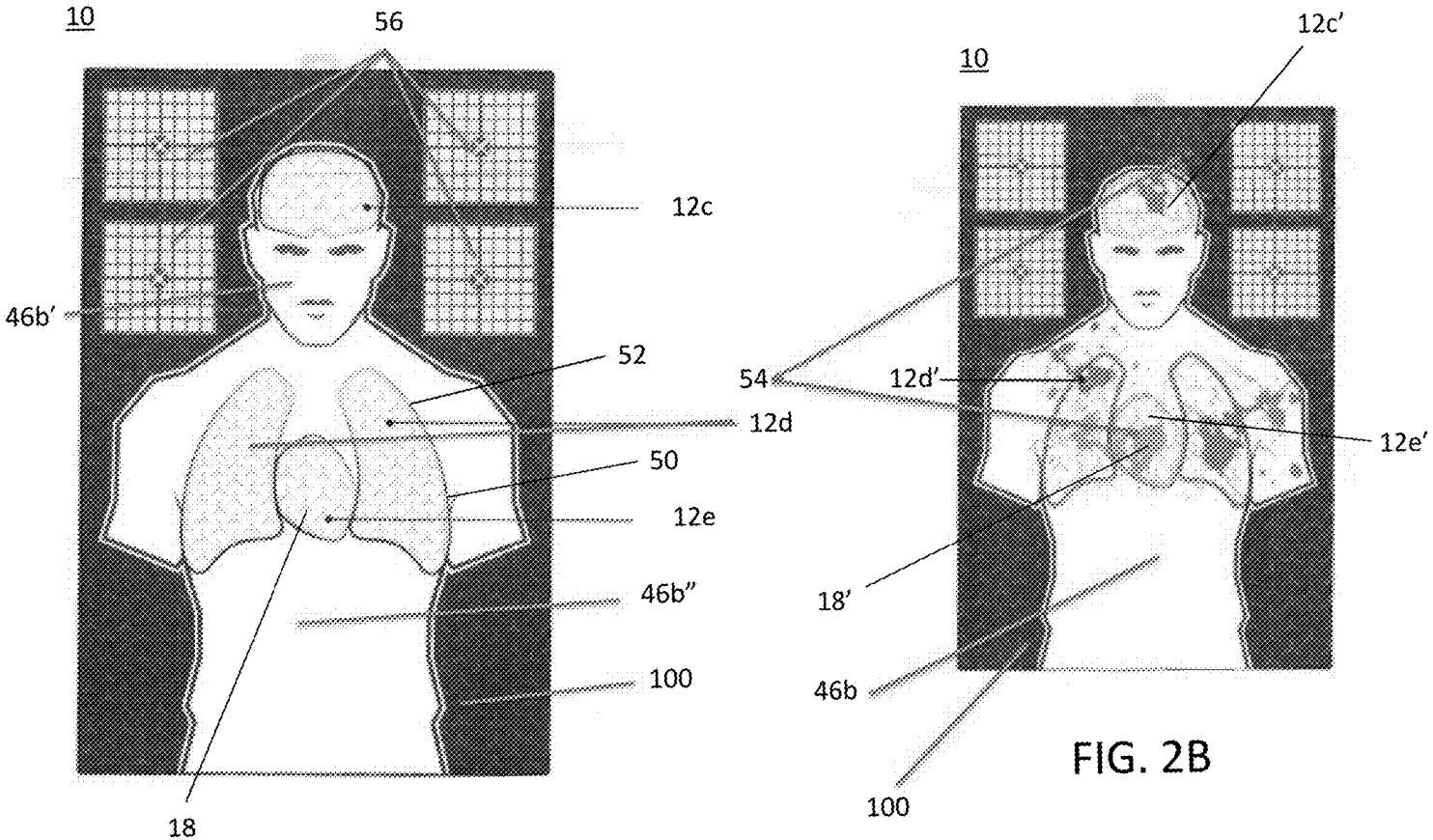
FIGS. 2A and 2B show front views of a target panel having indicia depicting a human torso, neck and head and splatter packs in the shape of a human's vital organs, before and after being hit with a projectile.
Figure 2D:
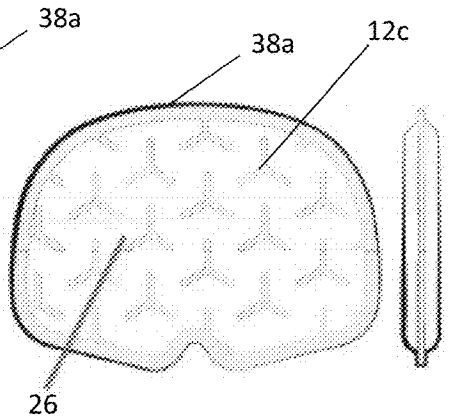
FIGS. 2C-2E respectively show front and side views of splatter packs in the form of a human lung, a human heart, and a human brain.
Figure 2E:
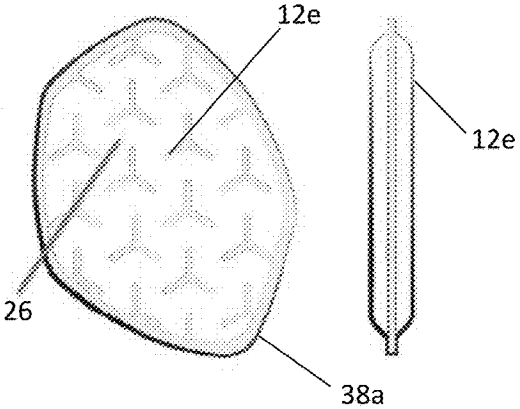
Figure 2C:
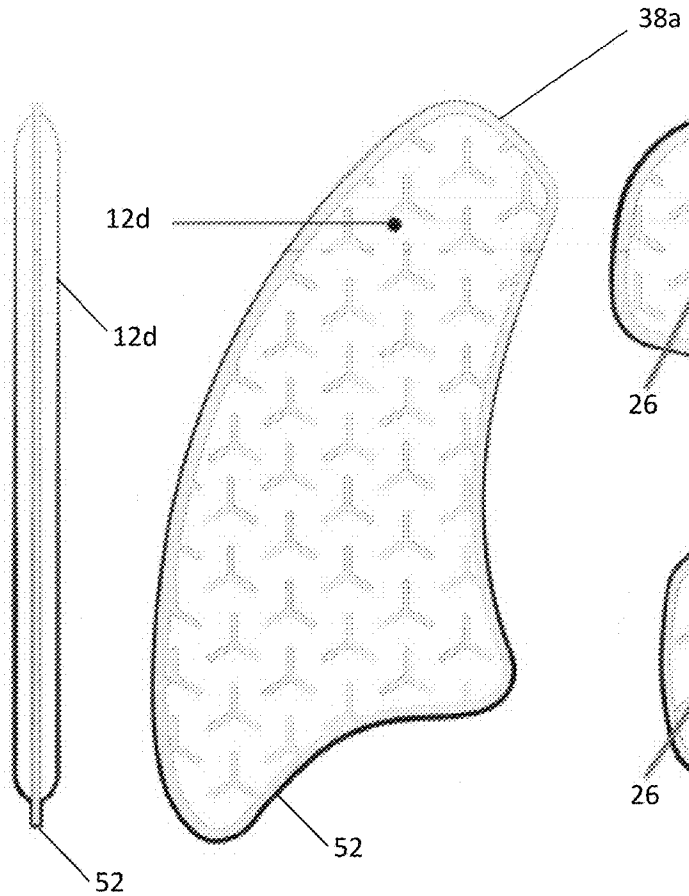
Figure 3:
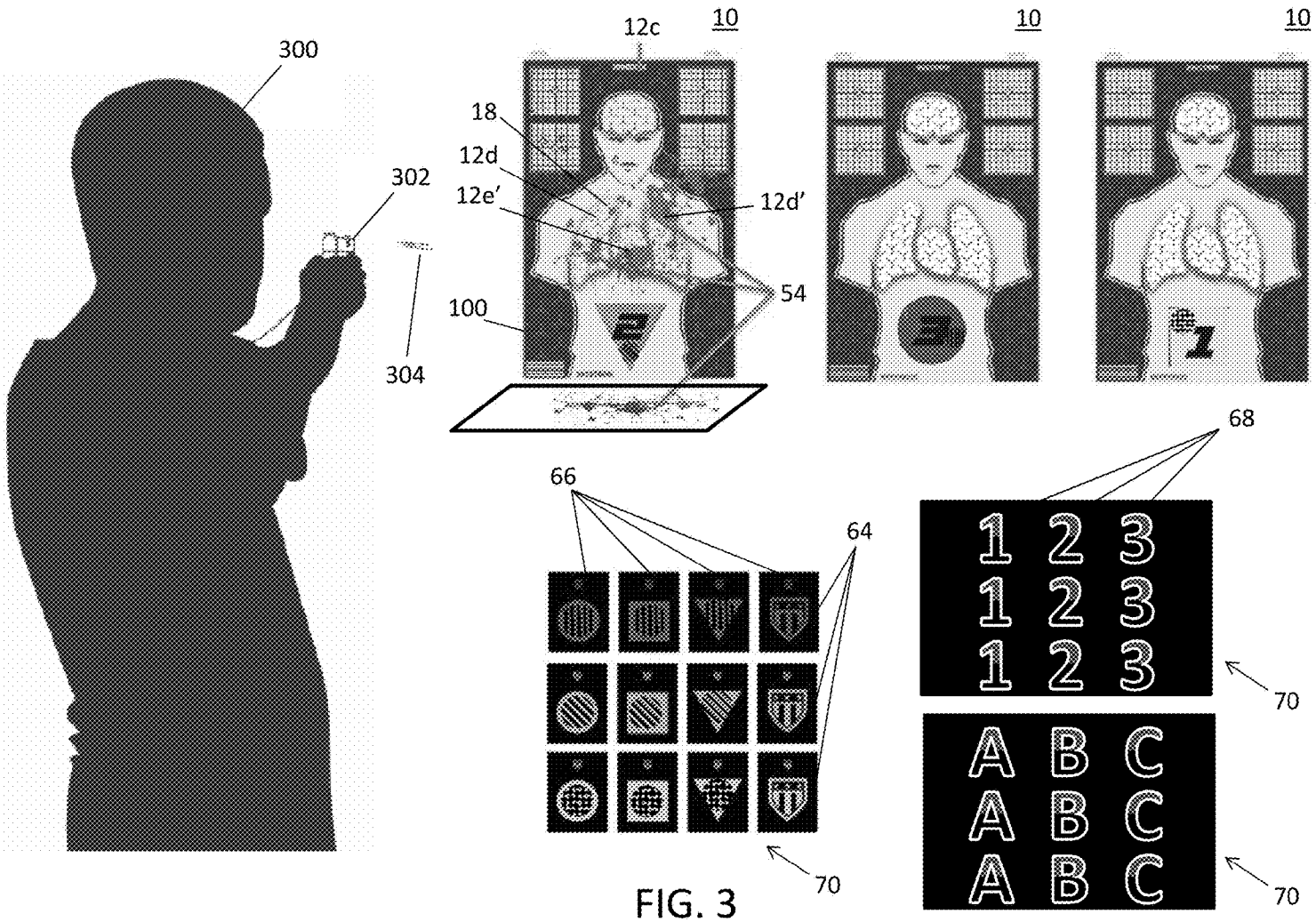
FIG. 3 illustrates operational use of the target system of the present invention, wherein a user aims a firearm at the target, discharges the firearm and fluid is discharged from the splatter packs and produces splatter on and around the target panel.

FIGS. 1A and 2A show the splatter packs 12 in their intact state, and FIGS. 1B and 2B show fractured splatter packs 12' following impacts from bullets which produce puncture holes 38 in the chambers 18 thereby releasing the fluid 14. FIG. 3 shows a marksman 300 aiming a firearm 302 at one of the targets 10 and firing a projectile 304 that impacts a splatter pack 12. The projectile penetrates the chamber 18, producing punctures 38 through the splatter pack 12 and the target panel 100, and the fluid is forcibly ejected from the penetrated gel packet which produces splatter 54 on and around the splatter pack 12 and the target panel 100. As explained in detail below, FIG. 3 also exemplifies how the targets 10 can be used for training with cognitive shooting drills.

Figures 1C, 1D:
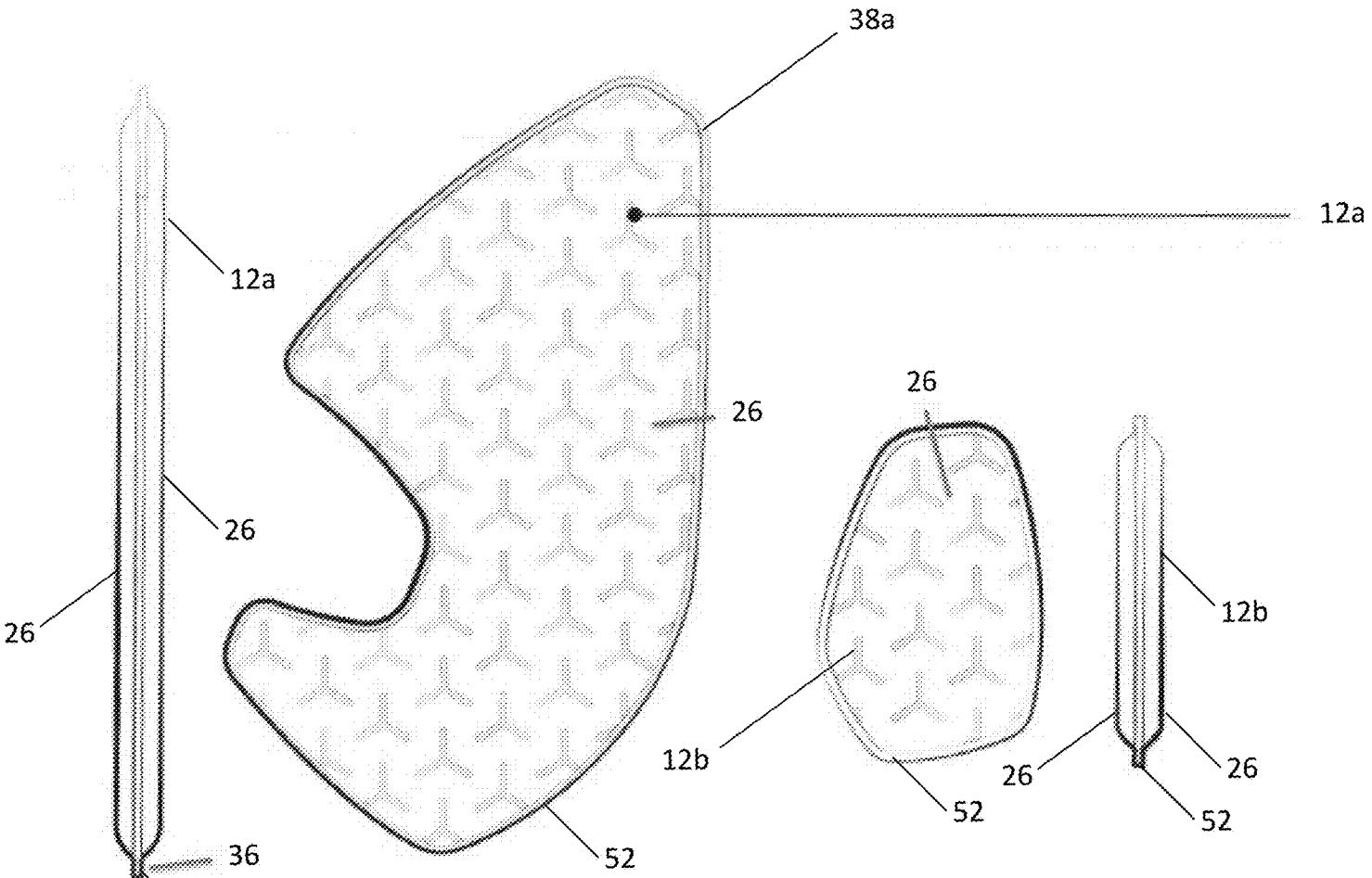
FIGS. 1C and 1D respectively show a front and side view of the splatter packs in the shape of a deer lung and deer heart.

As evident from FIGS. 1-3, different color fluids can be used for splatter packs depending on the vital areas being depicted. For example, the area in which the heart would be located has a splatter pack filled with a red gel, the area in which the lungs would be located has a splatter pack filled with a blue gel, and the brain splatter pack has a yellow gel. The different colors of the fluid and corresponding splatter 54 for different vital organs allow the marksman to more easily determine the location where the projectile impacted the target. The fluid can also contain various additives including, but not limited to, sparkles, confetti, glitter, rice, sand, and/or free floating or suspended fibers having a reflective quality. The splatter 54 gives the shooter a visual indication that the shot hit the target. Furthermore, when a target is at a distance where a puncture hole alone would not be readily visible without the some telescopic aid, the spatter 54 provides a more expansive visual indication that the target has been hit.

The liquid 14 in the splatter packs 12 is preferably dyed with colors that are highly visible in the splatter 54 on the exterior surface 26 of the front ply 32 that forms the chambers 18 when released through the punctures 38. Preferably, the splatter packs are white or some other light color that provides a high contrast with the color of the dyed liquid. As one example, the liquid can be a gelatinous, water-soluble paint. In another example, the liquid can be a three percent (3%) gelatin mixture. The splatter packs may also be filled, at least in part, with a fluorescent dye which fluoresces in ultra violet light which can create a "glow in the dark" effect. The color of the fluid preferably also provides a contrast with the color of the front surface 20 of the target panel 100, such as a simulated mammal base, in addition to the exterior surface 26 of the splatter packs 12. This can also be in the form of a tracer compound and is sometimes visible as green or red light to the user. In some embodiments, the fluid may be contained within a transparent chamber material and contrasts with the target panel which could make the target more easily visible to the marksman from longer ranges while showing the contrasting splatter color on the front of the target panel when released from the chambers. Regardless of splatter pack clarity/opacity, the splattering of the fluid is more visible upon the rupturing of the chamber. Preferably, the splatter packs, including the fluid therein, is comprised of components which will not attract insects, such as ants.

Figures 4A, 4B, 4C, 4D:
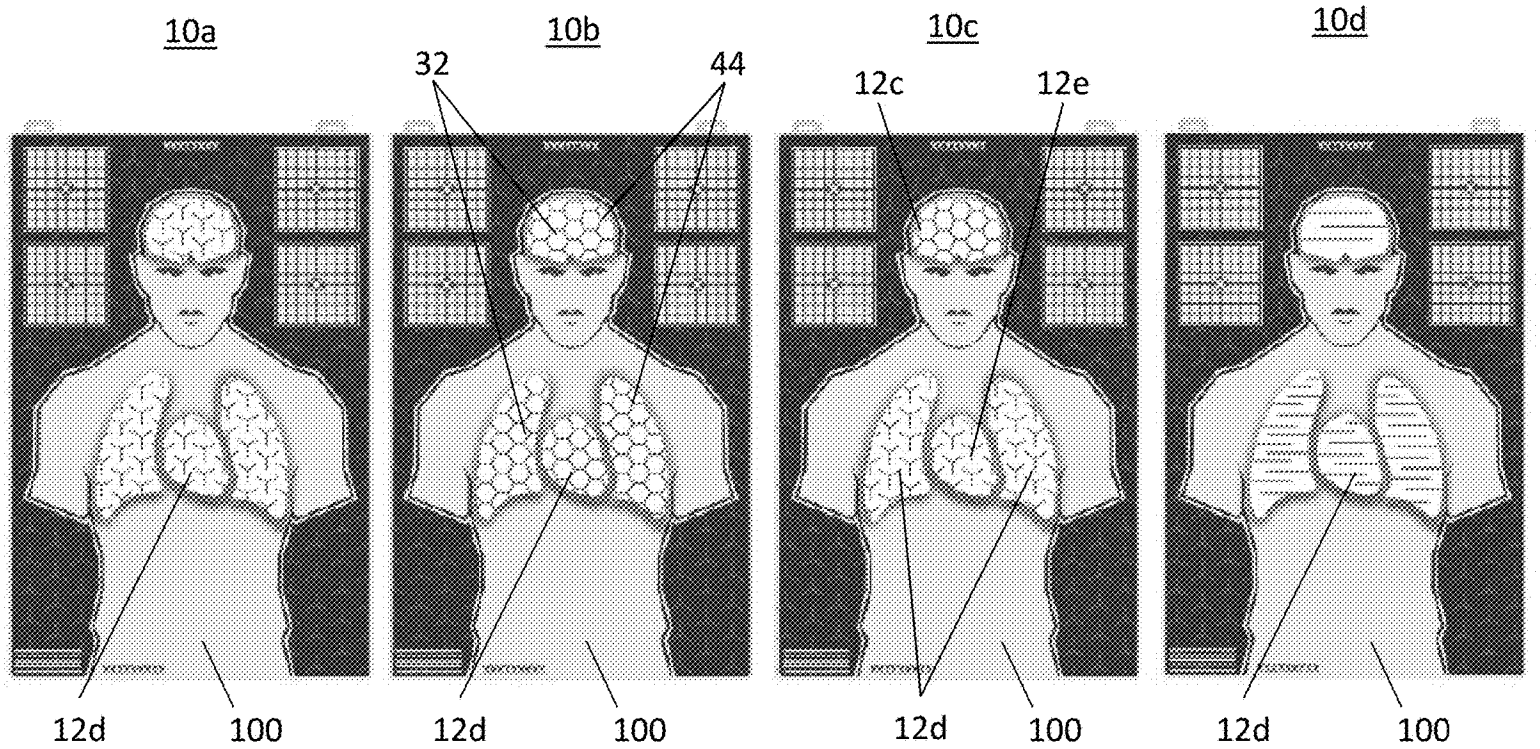
FIGS. 4A-4D each show a front view of target panels with splatter packs having different chamber structures.

The chambers 18 can take any number of shapes, including but not limited serpentine chambers, honeycombed chambers, horizontal chambers, vertical chambers, or other chamber variations. For example, the brain packet could be horizontally ribbed, the lungs vertically ribbed, and the heart orthogonally serpentine. Various chamber patterns can be used for the splatter packs, and different patterns can be used for different splatter packs 12 on the same target panel 100 as shown by the splatter pack targets 10*a*-10*d* respectively shown in FIGS. 4A-4D. FIG. 4C illustrates a splatter pack target 10*c* with different chamber 18 patterns on the target panel 100, combining a honeycombed patterned brain splatter pack 12*c* with a "Y" patterned lung splatter pack 12*d* and heart splatter pack 12*e*.

Figures 5A, 5B, 5C, 5D, 5E:
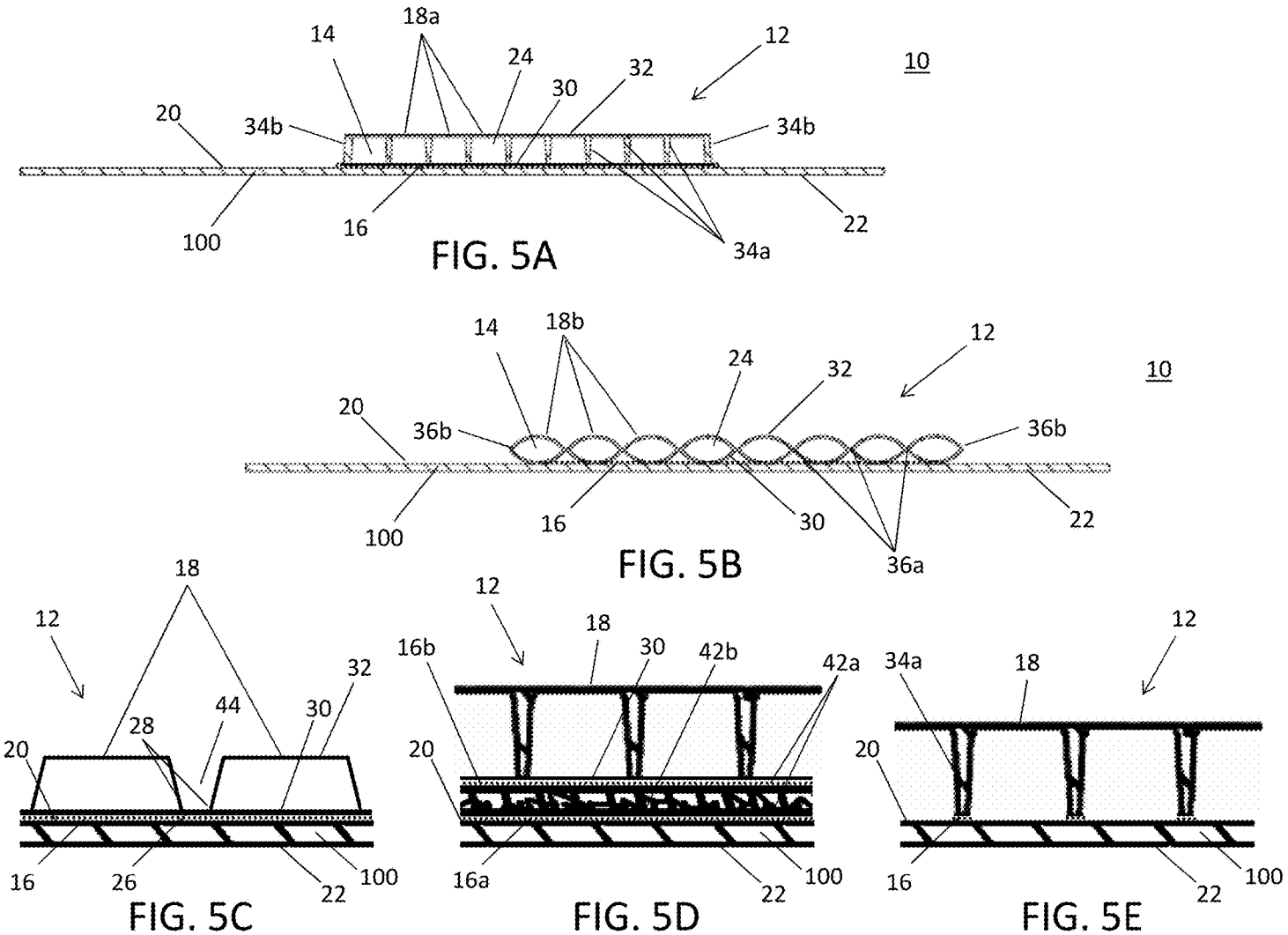
FIGS. 5A and 5B show cross-sectional side views of splatter packs attached to target panels.
FIGS. 5C-5E show detail cross-sectional side views of splatter packs attached to target panels.

As indicated above, the splatter packs 12 generally contain separate chambers 18, each of which has an interior space 24 in which the fluid boluses 14 are dispensed. According to the embodiment shown in FIG. 5A, the fluid 14 is divided by interior walls 34*a* into rigid chambers 18*a* surrounded by a rigid perimeter wall 34*b* at the outer perimeter 52 of the splatter pack 12. The interior walls may be formed integrally with the front sheet 32 or the back sheet 30 by thermoforming a thin plastic sheet into multiple chambers or by injection molding or any other manufacturing means, and the opposing sheet (back sheet 30 or front sheet 32) seals the fluid 14 within the chambers. As shown in FIG. 5B, flexible chambers 18*b* can be formed by flexible membranes which have an internal seam 36*a* connecting the back ply 30 and the front ply 32. A perimeter seam 36*b* surrounds the perimeter 28 of the flexible splatter pack 12. The seams 36 may be formed by a heat seal in any number of shapes and patterns.

Generally, when the splatter pack is attached to the target panel 100, the exterior surface of the back ply 30 is concealed from view because it is attached to the front surface 20 of the target panel 100 which has a greater surface area than the splatter pack. Accordingly, only the exterior surface of the front ply 32 is exposed to view for the marksman. In yet another embodiment of the target 10 shown in FIG. 5C, a front sheet 32 is formed into multiple chambers 18 with channels 44 between the chamber perimeters 28. The back sheet 30 covers the chambers and is laminated to the sections of the front sheet in the channels between the chambers to seal the fluid in the interior of the chambers. In each one of these embodiments, the adhesive layer 16 laminates the splatter pack 12 to the target panel 100 by bonding the exterior surface 26 of the back ply 30 to the target panel's front surface 20.

As shown in FIG. 5D, strips of hook and loop fasteners 42 can also be sandwiched between two adhesive layers 16*a*, 16*b* to secure the splatter pack 12 to the target panel 100. The adhesive layers 16*a* connect the backsides 42*a* of the respective sides of hook and loop fasteners to the back ply 30 of the splatter pack 12 and the front surface 20 of the target panel 100, and the mating sides 42*b* of the hook and loop fasteners releasably connect to each other. Additionally, as shown in FIG. 5E, the front side 20 of the target panel 100 can serve as the back ply in which case the adhesive layer 16 connects the back surface of the interior walls 34*a* directly to the target panel's front side 20.

It will also be appreciated that other fasteners and connectors could be used to attach the splatter packs to the target panel, such as male and female connectors that are attached to the exterior surfaces of the target panel and splatter packs. For example, magnets can be used as fasteners, such as when the target panel is formed from a ferromagnetic metal. In such a case, the magnets could be fastened to the back ply of the splatter pack and no magnets would be necessary on the target panel. Of course, magnets could be applied to a cardboard target panel which would mate with the magnets on the splatter pack. The use of an adhesive layer either by itself or in combination with flexible strips of hook and loop fasteners (or magnetic strips) to connect the splatter packs to the target panel is preferred over the use of rigid localized connectors and fasteners that are likely to be destroyed when impacted. The adhesive layer and hook and loop fasteners can be distributed throughout the region between the splatter pack and the target panel and would continue to function during the operational lifespan of the splatter pack, whereas most other types of connectors and fasteners would be positioned in discrete locations so they would be more subject to failure when destroyed by bullet impacts.

Figure 6A:
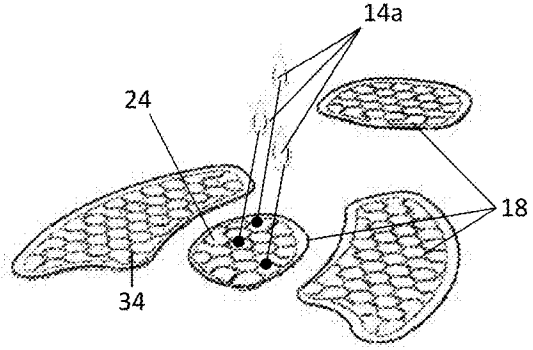
Figure 6B:
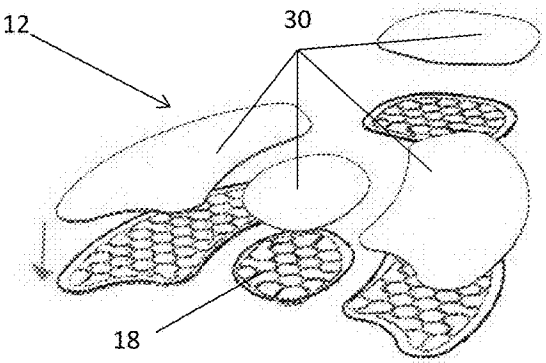
Figure 7A:
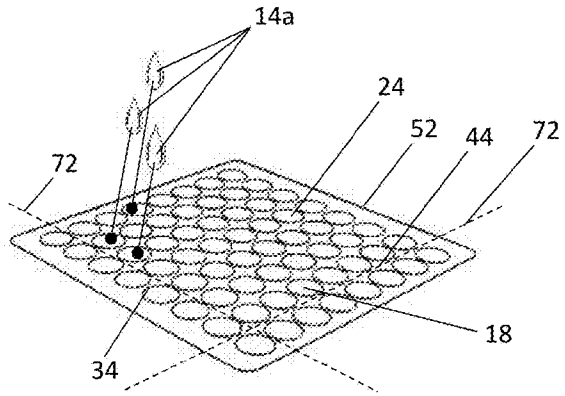
Figure 7B:
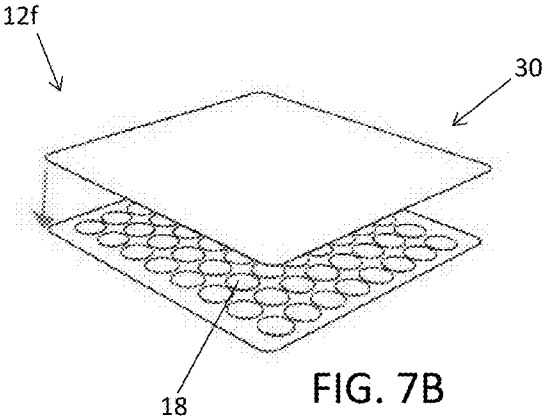
Figure 8A:
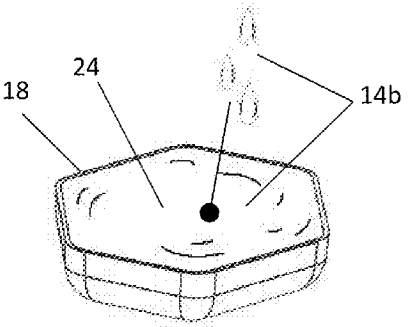
FIGS. 8A-8C show a splatter pack with an individual chamber having an open backside and fluid being deposited into the chamber and then sealed with a backside ply with adhesive layer and a film being peeled off the backside ply to expose the adhesive layer.
Figure 8B:
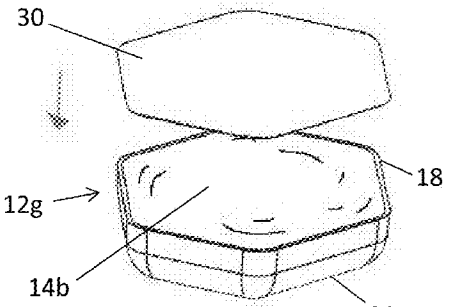
Figure 8C:
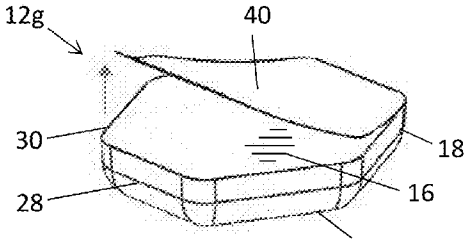

The cellular structures of the receptacle chambers 18 hold fluid boluses 14*a* and can also function as a rigid, semi-rigid or flexible skeletal structure for the splatter pack 12 to help retain the splatter pack's shape as it is repeatedly impacted with projectiles 304 which result in punctures 38 through the splatter pack 12 and the target panel 100. As particularly shown in FIGS. 6A and 7A, multiple fluid boluses 14*a* can be dispensed into multi-chamber splatter packs 12 which have multiple chambers 18 that are fixedly connected together. As shown in FIGS. 8A and 8B, a single-chamber splatter pack 12*g* can be formed by an individual chamber 18 that has a corresponding fluid bolus 14*b*.

The multi-chamber splatter packs 12 or single-chamber splatter packs 12*g* can be attached to the target panel 100 in different ways and different arrangements. For example, the targets 10 may be produced with the splatter packs 12 adhered to the target panel 100, or as evident from FIGS. 6-8, the targets can be produced with the splatter parts separate from the target panel and can be attached by the marksman or other user. To attach the splatter pack 12 to the target panel 100, a user removes a film 40 from the adhesive layer 16 on the back ply 30 which exposes the adhesive layer 16, and the user presses the splatter pack to the target panel with the adhesive layer facing the target panel's front surface 20. The film removal and affixation process can be repeated by users for different multi-chamber splatter packs 12 as shown in FIGS. 6 and 7 or single-chamber splatter packs 12*g* which can be applied in splatter pack groups as shown in FIG. 8D or as a replacement splatter pack as shown in FIG. 8E. When the film is attached to and in contact with the adhesive layer on the back ply, i.e., before being peeled away or otherwise detached from the back ply, the film functions as a protective barrier for the adhesive layer and the back ply.

Figure 6C:
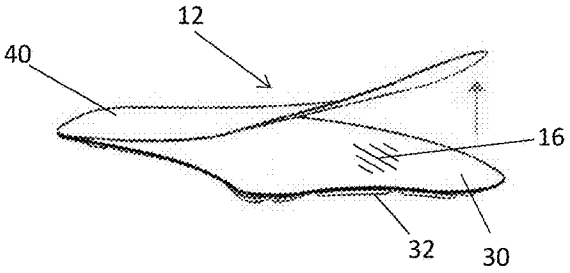
FIGS. 6A-6C show back isometric views of splatter packs shaped like a humanoid's organs, each splatter pack having an open backside with fluid being deposited into chambers and then sealed with a backside ply with adhesive layer and a film being peeled off of the backside ply to expose the adhesive layer.
Figure 6D:
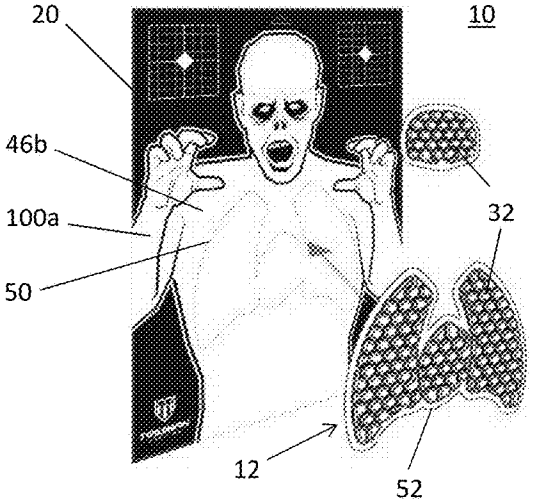
FIG. 6D shows a front view of splatter packs similar to the splatter packs of FIGS. 6A-6C being affixed to a target panel.

The target panels 100 preferably include silhouette indicia 46 on a portion of the front surface 20 of the target panel 100*a*, and the splatter packs 12 are preferably formed with an outer perimeter having body part shapes 48*a* that correspond with the silhouette indicia. For example, the deer lung splatter pack 12*a* and deer heart splatter pack 12*b* as shown in FIGS. 1A-1D correspond with a deer torso silhouette 46*a*. Similarly, that human brain splatter pack 12*c*, human lung splatter pack 12*d*, and human heart splatter pack 12*e* as shown in FIGS. 2A-2E correspond with a humanoid silhouette 46*b* with a head 46*b*' and torso 46*b*". As shown in FIG. 6D, the target panel preferably also includes an outline shape 50 that matches the perimeter 52 of the body part splatter pack 12. Further, as shown in FIGS. 1A, 1B, 2A, and 2B, target panels 100 may also depict zeroing targets 56, such as a data on personal equipment (DOPE) grid. The DOPE grid allows the marksman to test the performance of the firearm in relation to various variables and conditions, such as the particular ammo, distance, weather conditions, etc.

Figure 6F:
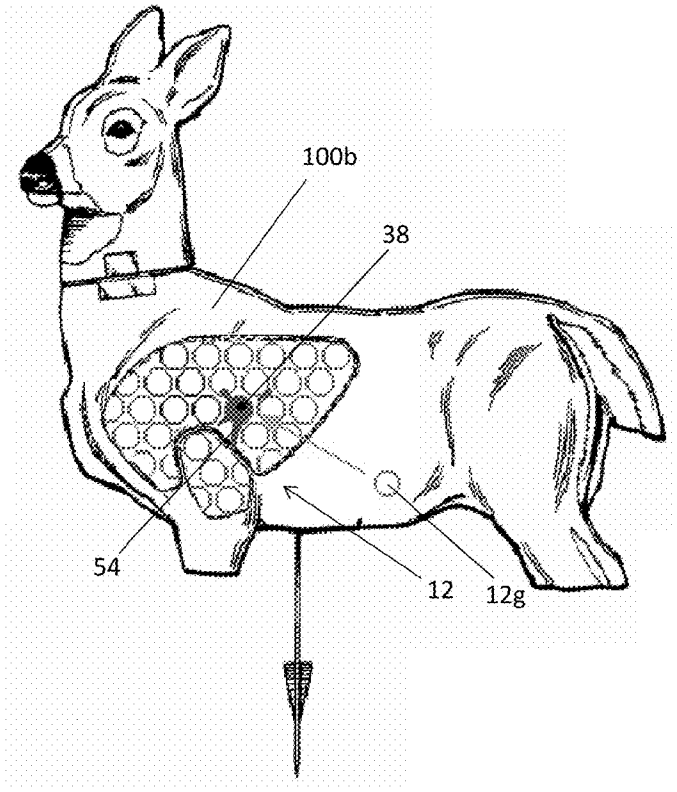
FIGS. 6E and 6F show side views of a three-dimensional target with a splatter pack attached to the exterior of the target panel.
Figure 6E:
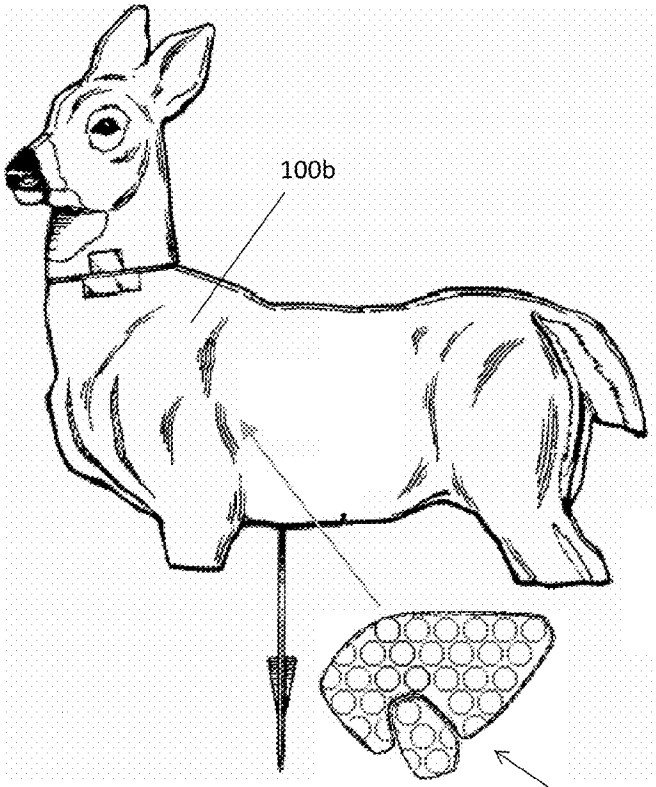

As shown in FIGS. 6E and 6F, the splatter pack 12 may also be attached to the exterior of a three-dimensional target panel 100*b*. The thin plastic channels 44 between the chambers allow the splatter pack to conform to the shape of the target panel 100*b*. Of course, the flexible splatter pack would also readily conform to the target panel. When the target 10 is impacted, a burst chamber 18' with a puncture 38 results, and the fluid is initially ejected through the puncture and then drips through the puncture to form the splatter 54. A single-chamber splatter pack 12*g* can be placed over the burst chamber and the puncture. The single-chamber splatter pack is described in detail below with regard to FIGS. 8A-8E.

As shown in FIGS. 7A-7D, splatter packs 12*f* may also be formed as various geometric shapes 48*b* that can be attached to a blank target panel 100*c* without any indicia or attached to a marked target panel 100*a* with indicia or to a three-dimensional target panel 100*b*. The shape of the splatter pack 12*f* shown in these illustrations of FIG. 7 is square, but it will be appreciated that geometric splatter packs can be formed in any shape, such as triangles, circles, hexagons, and stars. Additionally, it will be appreciated that the shape of the chambers 18 in the splatter pack 12 can vary. For example, as shown in FIGS. 7A-7D, the cellular shape of the chambers are circular whereas in FIGS. 6A-6D, the cellular shape of the interior chambers are hexagonal while the shape of the chambers at the outer perimeter 52 of the splatter pack 12 have interior sides with shapes that match the shape of the interior hexagonal chambers and outer sides that match the splatter pack's outer perimeter.

The splatter packs shown in FIGS. 7A-7D have chambers that are aligned with each other in a series of rows and columns such that orthogonal straight lines 72 extend in the channels 44 between opposite sides of the outer perimeter 52 without intersecting any of the chambers 18. In comparison, according to the preferred embodiments of the present invention as shown in the other drawings, the chambers are arranged in a staggered geometric pattern. In the staggered geometric pattern, at least one of the orthogonal straight lines arranged in a channel must intersect at least one of the chambers. According to the preferred embodiments, there is no set of orthogonal straight lines that can extend in the channels between opposite sides of the outer perimeter without one of the orthogonal straight lines having one or more intersections 74 with the chambers 18.

Regardless of the shape or size of the splatter pack or the number of chambers within the splatter pack or the arrangement of chambers, the splatter pack is attached to the front surface 20 of the target panel 100 by the adhesive layer 16 or other fastening means which allow for the releasable connection of multi-chamber splatter packs 12 to the target panel or for single-chamber splatter packs 12*g* to be placed over burst chambers 18' as shown in FIGS. 6F and 8E. Accordingly, the splatter pack target 10 improves the ease and speed in which one or more bursting chambers 18' in impacted splatter packs 12' can be replaced with a corresponding number of single-chamber splatter packs. Accordingly, single-chamber splatter packs 12*g* can be placed onto the target panel 100 in place of the burst chambers 18' in impacted target packets 12'. Alternatively, the entire splatter pack 12 could be peeled off of the front surface 20 of the target panel 100, and a new splatter pack 12 can be affixed in its place. In prior art targets with bursting chambers or colored internal layers, the chambers and layers are integrally formed as a part of the target panel so when the chambers are burst or the layers are punctured, they cannot be readily replaced without further damaging the underlying target panel. In comparison, the removable multi-chamber splatter packs and single-chamber splatter packs of the present splatter pack target invention allow users to quickly replace burst chambers 18' or the entire splatter pack in a way that increases the strength of the impacted target rather than further damaging it.

Figure 7C:
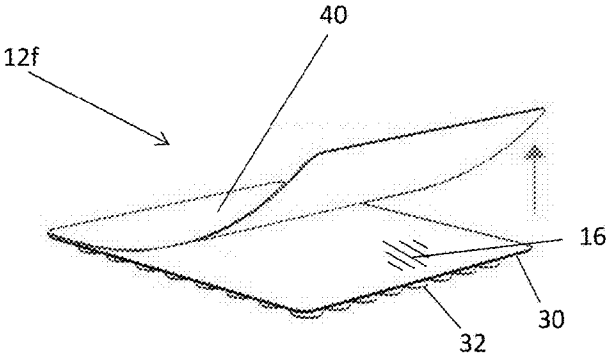
FIGS. 7A-7D show an alternative splatter pack and target panel.
Figure 7D:
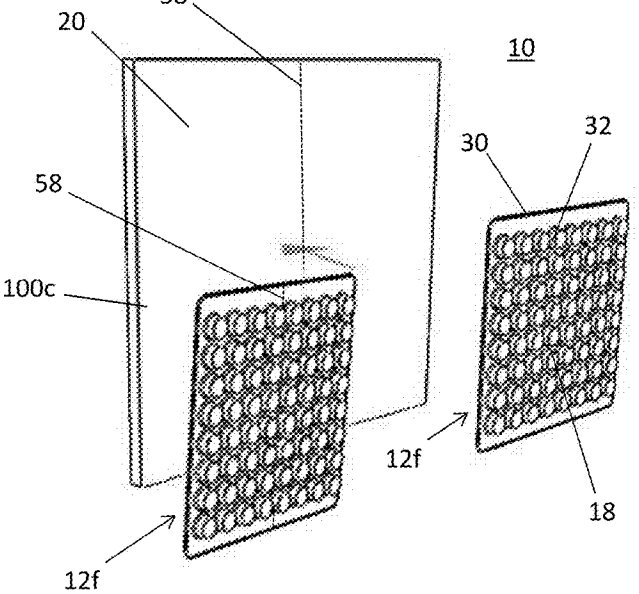
Figure 8D:
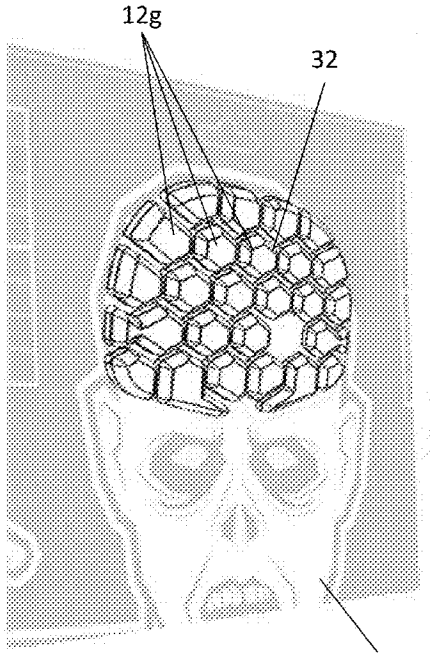
FIGS. 8D and 8E show the attachment and arrangement of multiple individual splatter packs as shown in FIGS. 8A-8C on a target panel.
Figure 8E:
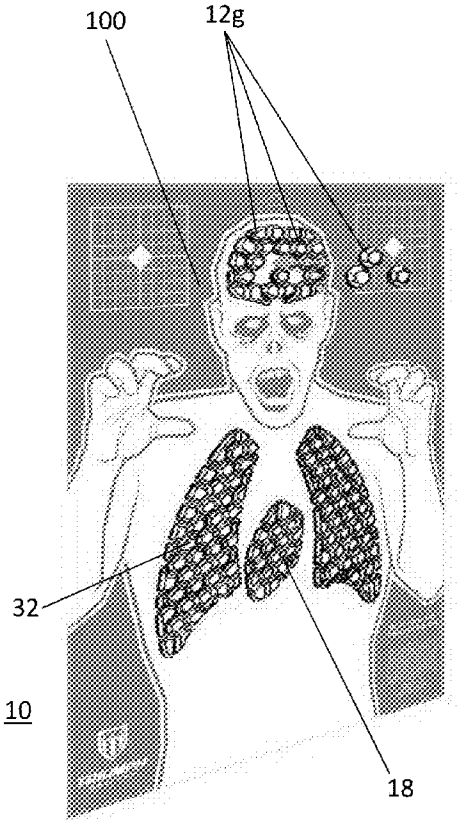
Figure 9B:
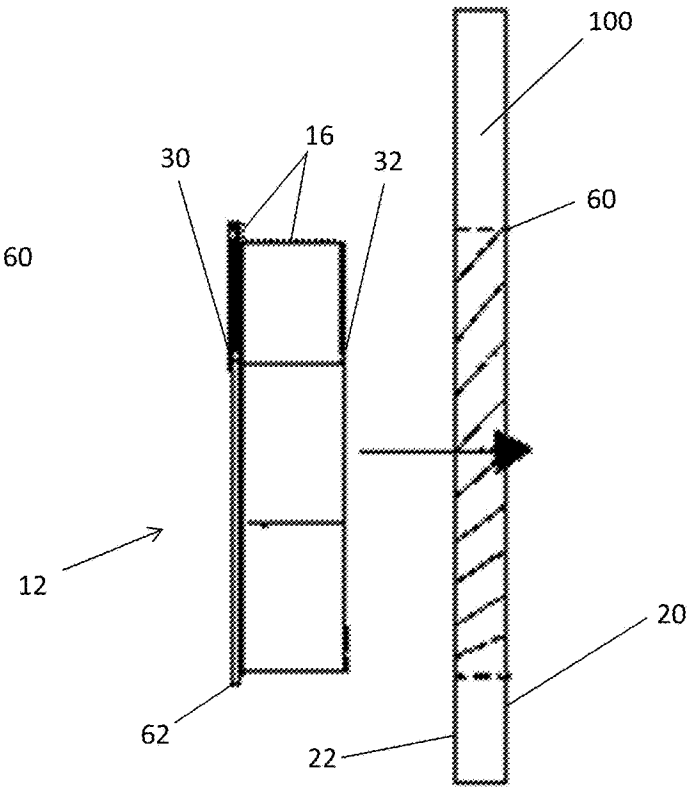
FIGS. 9A and 9B respectively show a front view and a cross-sectional side view of individual splatter packs fixed to a target base by insertion through an aperture.
Figure 9A:
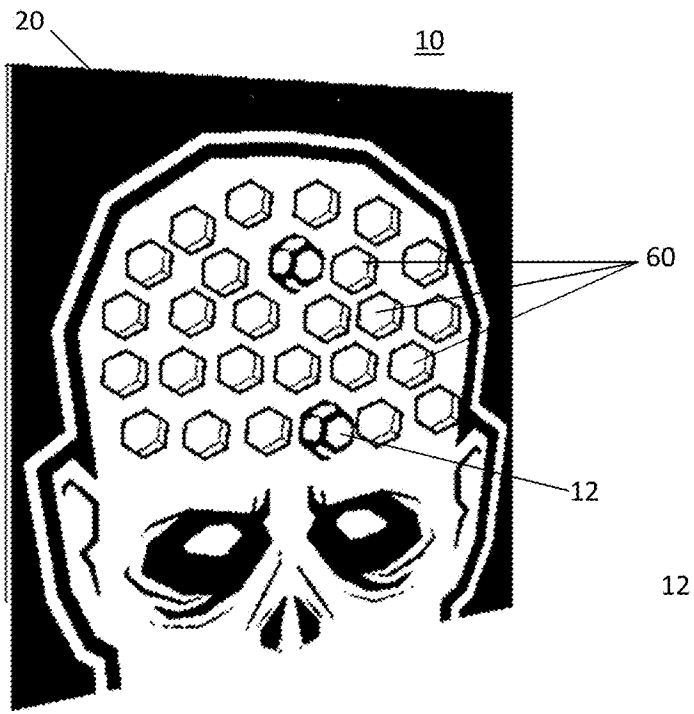

In addition to varying the splatter pack shape 48 or the arrangement of chambers 18 within the splatter packs, another inventive feature of the target panels 100 is the fold line 58 as shown in FIG. 7D. The fold line allows a user to easily fold the target panel 100 into a smaller size that can be more easily stored and transported. Although FIG. 7D depicts a single fold, other embodiments of the splatter pack target 10 may contain multiple folds that can all be in the same direction or that may be orthogonally arranged, such as a vertical fold and a horizontal fold. As shown in FIG. 7D, splatter packs 12*f* with at least one straight line channel may have a fold line 58 in the channel that can be aligned with target's fold line 58 which would allow the splatter packs to fold with the folding target panel. As also shown in FIG. 7D, splatter packs 12*f* can be positioned on opposing sections of the target panel that are divided by the fold line 58.

Target panels 100 can be constructed from a variety of materials such as, but not limited to, paper, wood, plastic, foam, composites, woven fabrics, metal, corrugated cardboard, and/or concrete. In some embodiments, the target panel 100 is three-dimensional and self-supporting while in others it is flat may be either suspended from a frame or otherwise attached to a frame or other support structure. Regardless of the support structure, the splatter pack can be affixed to any number of target panel surfaces including but not limited to those having contours, curves, ridges, depths, and/or protrusions. Easy affixation remains where an embodiment of the splatter pack is a flexible membrane or other flexible structure that forms to the shape of the target panel 100. The splatter pack 12 preferably has a very thin profile relative to the length and width and the flexible form of the target packet primarily maintains its planar shape due to the connection to the target panel and to a lesser degree its internal structures. The thickness of the splatter packet is generally less than an order of magnitude smaller than its length and width. For flat target panel backings, the thickness of the splatter packet is typically within the order of magnitude of the panel's thickness or the shell material thickness for three-dimensional targets.

A single splatter pack 12 can cover multiple areas or regions of a simulated mammal and may give an appearance of multiple packets. For example, as shown in FIG. 6D, a splatter pack is a single unit that takes the shape of two lungs and is attached to the target panel as a single unit. The front and back membranes or plies of the splatter packs can be joined together in only some sections to permit the internal fluid can travel between the partitions of the splatter pack. Accordingly, it will be appreciated that heat sealing can be used to connect the front ply to the back ply in various patterns while some areas between the compartments are left unsealed to create an internal channel which allows fluid to flow between the partitions. In such embodiments, although the internal channel may result in the splatter pack having a single chamber (because the compartments are in fluid communication with each other), the partitions between the compartments can limit the amount of fluid that flows out of the punctures. In certain embodiments, the concept is similar to that of air cushion packaging materials, i.e., bubble wrap. For example, areas of bubble wrap without a sealed bubble create a space between the lung pocket(s) and the heart pocket.

As illustrated in FIGS. 8A-8E, individual splatter packs 12*f* can be formed with chambers 18 that each have a front ply 32 individually sealed with a and a back ply 30 with can be independently affixed to the target panel 100, as shown in FIGS. 8 and 9. Although the individual chambers 18 of this embodiment are not physically attached about their perimeter 28, they are affixed adjacent to one another and collectively define the splatter pack 12 on the target panel 100. This embodiment promotes easier replacement of individually burst packs 12 while maintaining the functionality and inventiveness of the splatter pack target 10 as a whole. Additionally, the individuality of the chambers 18 allow a marksman to arrange this embodiment into any desired pattern, including making the target area smaller or larger than the predetermined sizes of other embodiments.

As shown in FIG. 9, splatter packs 12 can be attached to the target panel 100 inserting the splatter packs through apertures 60 between the front surface 20 and the back surface 22. In the case of a single-chamber splatter pack 12*g*, the periphery 28 of the splatter pack could have a friction fit connection with the sides of the orifice. A flange 62 may also help secure the splatter pack to the target panel. An adhesive may also be used to secure the splatter pack to the target panel. It will be appreciated that in the embodiment with apertures in the target panel, the splatter packs could be inserted from the back to the front as shown or from the front to the back.

Figures 10A, 10B, 10C, 10D, 10E, 10F, 10G, 10H, 10I, 10J:
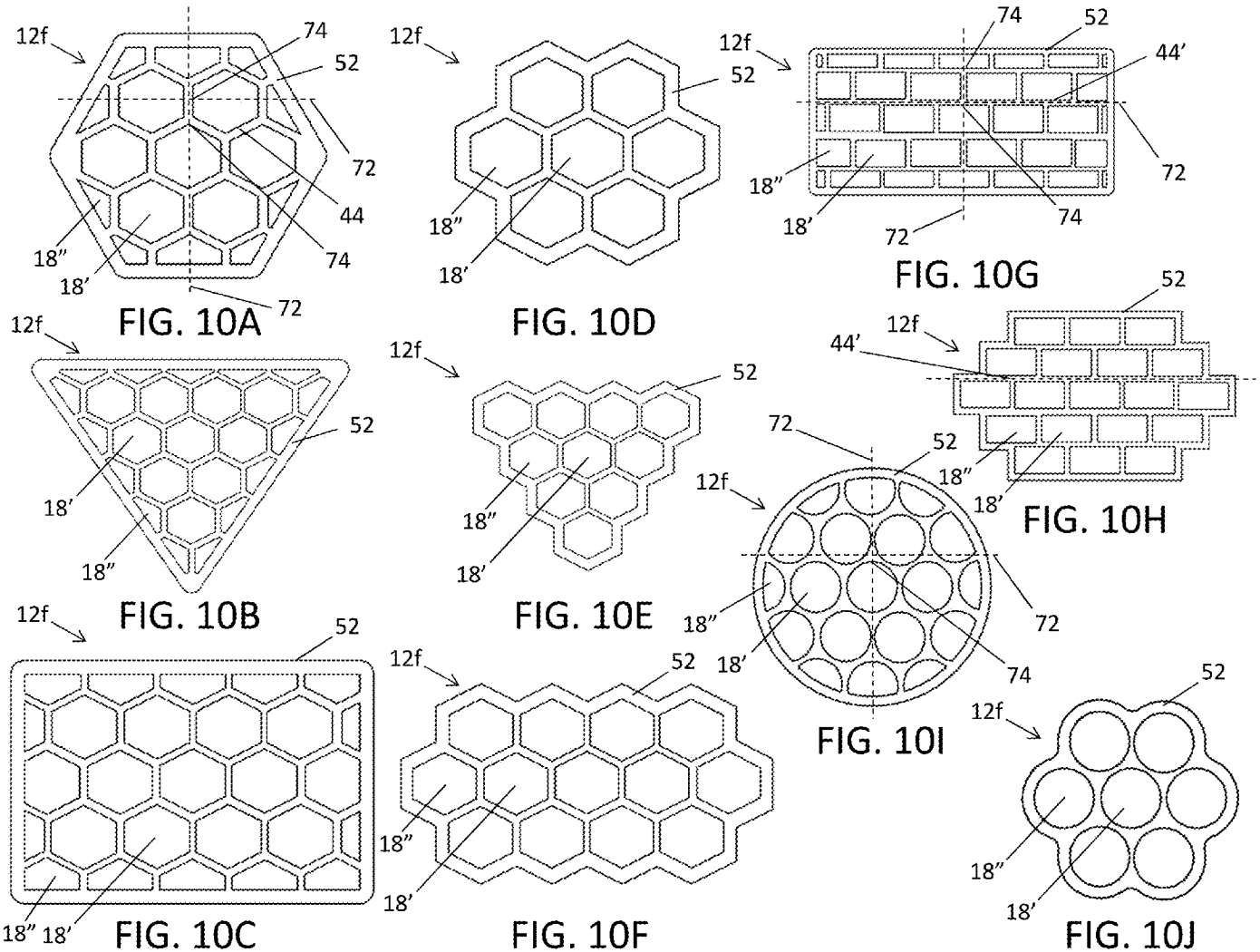
FIGS. 10A-10J show a front view of geometrically shaped splatter packs with chambers arranged in a staggered arrangement.

Splatter packs 12*f* with various outer perimeter 52 shapes and alternative cellular shapes for the chambers 18 are shown in FIGS. 10A-10J. Generally, as with all of the other embodiments disclosed herein with the exception of the splatter pack embodiment shown in FIGS. 7A-7D, the chambers are arranged in a staggered geometric pattern. In the staggered geometric pattern, at least one of the orthogonal straight lines arranged in a channel must intersect at least one of the chambers. As particularly illustrated in FIGS. 10A, 10G, and 10I, there is no set of orthogonal straight lines 72 that can extend in the channels between opposite sides of the outer perimeter without one of the orthogonal straight lines having one or more intersections 74 with the chambers 18. As discussed above with reference to FIGS. 7A-7D, splatter packs with chambers that are aligned rows and columns can be bent in the channels that form the rows and columns and may also permit chambers to be readily torn out or cut out from the splatter pack. In comparison, the staggered chambers provide more stability to the splatter pack and are more difficult to separate from each other since they are intended to remain together without being separated from the splatter pack. Some staggered configurations may have a unidirectional set of straight line channels 44' which can be folded in a single direction, such as shown in FIGS. 10G and 10H, but even these single direction foldable splatter packs have more stability and are more difficult to separate the chambers as compared with the orthogonally foldable and separable splatter packs.

To further support the stability of the splatter packs according to the present invention, the splatter pack design includes an outer perimeter 52 that is finished and solid, without any perforations, cut-lines, reduced thicknesses, or other features that would reduce the strength of the connection between chambers and allow for their separation. One set of interior chambers 18' are spaced inwardly from the outer perimeter of the receptacle while another set of peripheral chambers 18" are positioned adjacent to the outer perimeter of the receptacle. At least the interior chambers are staggered, and in the preferred embodiments, both sets of chambers are staggered.

The drawings in FIGS. 10A-10F show a honeycombed pattern with hexagonal chambers while FIGS. 10G-10J show chambers that have other geometric shapes. In particular, FIGS. 10G and 10H show rectangular chambers and FIGS. 10I and 10J show circular chambers. FIGS. 10A-10C, 10G, and 10I show splatter packs with linear outer perimeter sides with the peripheral chambers having a different shape than the repeating cellular shape of the interior chambers. The outer perimeter sides can also be nonlinear, such as the curved sides of the body organ shaped splatter packs shown in FIGS. 1-4 and 6. The body organ splatter packs also have staggered chambers and a finished solid outer perimeter and preferably have peripheral chambers shaped differently from the interior chambers. For splatter packs that have differently shaped peripheral chambers from the interior chambers' cellular shape, the side of the peripheral chambers facing the first set of chambers preferably has a shape matching the cellular shape with same staggered pattern, and the second side of the peripheral chambers facing the outer perimeter has a different shape matching the outline shape of the finished outer perimeter. According to the embodiments described above, the outline shape can have curved sides or straight sides.

Splatter packs with another type of nonlinear sides are shown by the geometrical splatter packs in FIGS. 10D-10F, 10H, and 10J. In these geometric splatter packs, the peripheral chambers may retain the same shape and match the staggered pattern with the interior set of chambers which may be one or more interior chambers. Since the peripheral chambers in these geometrical splatter packs have the same whole shape as the cellular shape of the interior chambers, each one of the nonlinear sides of the finished outer perimeter has a repeating geometric shape corresponding with a segment of the cellular shape.

Generally, splatter packs 12 can be constructed from various natural or synthetic materials. In some instances, the packs are manufactured from plastic plies having a thickness which is configured to burst the packet 12 upon impact of a specific projectile, usually a bullet fired from a firearm, at specified speed so as to constructively necessitate the type of ammunition needed to burst the packet. Regardless of material, the packs themselves can be opaque or transparent. The fluid within the splatter packs are preferably a high visibility color with a high contrast to the opaque color of the exterior side of the splatter packs. Different fluid colors are preferably paired with different outer perimeter shapes of the splatter packs. It is also possible to produce highly contoured shapes with multiple regions that have different colors according to the region of the splatter pack. For example, with the combined heart and lung splatter pack described above with reference to FIG. 6D, the heart section can have a red fluid while the lung sections can have a blue fluid.

Another feature of the splatter pack target 10 is the fluid 14 that fills the chambers 18 of the splatter packs 12, and that define fluid boluses 14*a* and 14*b* within each chamber 18. In the preferred embodiment, the fluid 14 is a biodegradable material. The fluid can be any type of liquid, including a gel, and may also, or solely, include a pressurized gas that pops when the splatter pack 12 is impacted, creating a "boom" sound. In some embodiments, the fluid which fills the splatter packets is configured to be resistive to impact. This resistance can achieved with gels and other liquids that have surface tension characteristics which prevents a projectile that is traveling too fast from penetrating the packet (may have been shot too close). The splatter packs can be produced from synthetic materials that are designed to burst upon impact of a projectile of a certain caliber bullet and a corresponding speed. Such configuration could create thresholds, for instance 9 mm ammunition fired at 25 meters will penetrate the chamber wall but the same bullet from the same gun at 10 meters will not penetrate the chamber nor will the same bullet from the same gun at 50 meters.

In operation, a marksman will take a splatter pack 12 or chamber 18 and peel off the film 40. The marksman will then affix the receptacle to the target panel 100. In some embodiments the marksmen will be using a simulated mammal target panel 100 and thus will affix the appropriate splatter pack 12 within the silhouette indicia 46 depicted. This can be seen in FIG. 6D where a lung, heart, and brain splatter pack 12 are being affixed to a target panel 100 depicting a humanoid 46*b*. In other embodiments the marksman may affix a simple array splatter pack 12*f* onto a blank target panel 100, as shown in FIG. 7D, or simply arrange individual chambers 18 into any pattern the marksman would like. After the splatter packs 12 and target panel 100 have been assembled, a marksman may place the target system 10 at a desired distance, take aim and fire. When the bullet impacts and penetrates the receptacles 12, the receptacles are fractured and the fluid 14 held within the individual chambers 18 is forcibly ejected from the fractured receptacle through the puncture resulting in splatter 54 onto and around the target panel 100, and the marksman will be able to confirm delivery of an accurate shot on target. As indicated above, splatter 54 can be seen in FIGS. 1B, 2B, 3, and 6F.

After a marksman has put numerous holes in a splatter pack 12, they may elect to remove burst chambers 18' and replace them with replacement splatter packs 12*g*. To replace these spent chambers 18 a marksman need only peel off the protective film 40 and affix the replacement individual splatter pack 12*g* in the desired area on the target panel 100. In another embodiment, a marksman may insert the individual splatter packs 12*g* into the target panel's apertures 60, as depicted in FIG. 9.

As illustrated in FIG. 3, the front side 32 of the splatter packs 12 and/or target panels may have different color indicia 64 (magenta, green, yellow), shape indicia 66 (circle, square, triangle and logo) and/or alphanumeric indicia 68 (letters and/or numbers) which may printed directly thereon or may be printed on stickers 70 and adhered to the splatter packs and/or the target panel. The targets with the indicia on the splatter packs or target panels are used as part of a target system that enhances cognitive shooting drills in which each target has a splatter pack with a fluid serving as an internal indicia and an external surface having an external indicia that uniquely identifies each one of the targets. The marksman is provided with a combination of a shape, color and an alphanumeric character that defines a particular target, and the marksman aims the firearm at the defined target and discharges a projectile at the defined target from the firearm. The visual internal indicia provides a confirmation of impact as a visual impact indicator. As each target is impacted, a different target is defined by another combination and the marksman again shoots at the newly defined target. This process is repeated until all of the targets have been impacted.

According to the description of the embodiments above, it will be appreciated that the splatter pack target 10 provides several benefits over existing target systems. In particular, the splatter pack target 10 provides a shooting target of a shape generally resembling a specific mammal (or a portion thereof) that provides the user with visual confirmation of successful shot. This confirmation is accomplished by externally mounted removable and interchangeable aiming packs 12, which increase the lifespan of the target system 10 and allow a marksman to easily replace burst splatter packs 12 or individual chambers 18. In addition, the interchangeable splatter packs 12 and variable target panel 100 sizes allow a marksman to increase and decrease the target area to facilitate more difficult shots as they progress as a marksman. Regardless of the marksman's ability or embodiment being used, the fluid 14 expelled from a burst splatter pack 12 provides confirmation of a successful shot.

It will also be appreciated that sensors can be attached to the target panel 100 and/or the splatter packets 12. The sensors are preferably in wireless communication to a computer, either directly or indirectly and/or can communicate either directly or indirectly with a mobile computing device such as a phone. The sensors can measure a multitude of parameters such as angle, speed, rotation, location, tension, stress, or other such variables. In certain embodiments, the sensors will work in conjunction with lighting systems to provide the user with environmental variables which can assist in training of the user, such as a timer or if a target has not been hit, the sensor can send a signal to move the target closer to the user or in the alternative if a first vital component is ruptured, the system could automatically move farther from the user.

Throughout this disclosure the terms "mammal," "deer," "humanoid," and the like are used interchangeably; unless specified differently, the terms should be considered to be interchangeable. It will be appreciated that splatter packs having an animal organ shape can also be used on target panels having a humanoid indicia and vice versa, and the body-shaped splatter packs can be used on the target panels without any indicia and the geometric shaped splatter packs can be used on the target panels with mammalian indicia.

The embodiments were chosen and described to best explain the principles of the splatter pack target invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A splatter pack for a shooting target, comprising:

a receptacle comprising a front ply, a back ply, an interior space, an exterior surface, and an outer perimeter, wherein the interior space is sealed between the front ply and the back ply separate from the shooting target, wherein the receptacle is further comprised of a plurality of chambers, wherein a first set of the chambers has a cellular shape and is spaced inwardly from the outer perimeter of the receptacle, wherein a second set of the chambers is positioned adjacent to the outer perimeter of the receptacle, wherein at least the first set of chambers are arranged in a staggered geometric pattern, wherein a first side of the second set of chambers proximal to the first set of chambers has a first shape matching the cellular shape and staggered pattern, and wherein a second side of the second set of chambers proximal to the outer perimeter of the receptacle has a second shape matching a curved outline shape of the finished outer perimeter, and wherein the second set of chambers is selected from a group consisting of chambers having different shapes from the cellular shape and chambers forming a finished outer perimeter with a plurality of nonlinear sides;

a fluid sealed within each one of the chambers in the interior space of the receptacle; and a fastener connected to the exterior surface of the receptacle's back ply.

2. A splatter pack for a shooting target, comprising:

a receptacle comprising a front ply, a back ply, an interior space, an exterior surface, and an outer perimeter, wherein the interior space is scaled between the front ply and the back ply separate from the shooting target, wherein the receptacle is further comprised of a plurality of chambers, wherein a first set of the chambers has a cellular shape and is spaced inwardly from the outer perimeter of the receptacle, wherein a second set of the chambers is positioned adjacent to the outer perimeter of the receptacle, wherein at least the first set of chambers are arranged in a staggered geometric pattern, wherein the second set of chambers is selected from a group consisting of chambers having different shapes from the cellular shape and chambers forming a finished outer perimeter with a plurality of nonlinear sides, wherein the nonlinear sides of the finished outer perimeter are further comprised of a curved outline shape with the second set of chambers having different shapes from the cellular shape, and wherein the curved outline shape has at least one of a plurality of body part shapes selected from the group consisting of a lung, a heart, a brain, and a lung and heart combination;

a fluid sealed within each one of the chambers in the interior space of the receptacle; and a fastener connected to the exterior surface of the receptacle's back ply.

3. The splatter pack of claim 2, wherein a first color of the fluid sealed in a first body part shape is different from a second color of the fluid sealed in a second body part shape.

4. The splatter pack of claim 1, wherein the staggered geometric pattern of the first set of chambers is a honeycomb pattern.

5. The splatter pack of claim 1, wherein the nonlinear sides of the finished outer perimeter are further comprised of the curved outline shape with the second set of chambers having different shapes from the cellular shape, wherein the curved outline shape has at least one of a plurality of body part shapes selected from the group consisting of a lung, a heart, a brain, and a lung and heart combination.

6. A splatter pack for a shooting target, comprising:

a receptacle comprising a front ply, a back ply, an interior space, an exterior surface, and an outer perimeter, wherein the interior space is sealed between the front ply and the back ply separate from the shooting target, wherein the receptacle is further comprised of a plurality of chambers, wherein a first set of the chambers has a cellular shape and is spaced inwardly from the outer perimeter of the receptacle, wherein a second set of the chambers is positioned adjacent to the outer perimeter of the receptacle, wherein at least the first set of chambers are arranged in a staggered geometric pattern, wherein the second set of chambers is selected from a group consisting of chambers having different shapes from the cellular shape and chambers forming a finished outer perimeter with a plurality of nonlinear sides, wherein the first set of chambers and the second set of chambers are arranged in a staggered geometric pattern, wherein the second set of chambers have the same whole shape as the cellular shape, and wherein each one of the nonlinear sides of the finished outer perimeter is further comprised of a repeating geometric shape corresponding with a segment of the cellular shape;

a fluid sealed within each one of the chambers in the interior space of the receptacle; and a fastener connected to the exterior surface of the receptacle's back ply.

7. The splatter pack of claim 6, further comprising a plurality of channels positioned between adjacent chambers in the first set of chambers and the second set of chambers, wherein each one of the chambers in the first set of chambers is intersected by at least one of the channels, and wherein there is no set of orthogonal straight lines that can extend in the channels between opposite sides of the outer perimeter without one of the orthogonal straight lines intersecting at least one of the chambers.

8. A splatter pack for a shooting target, comprising:

a receptacle comprising a front ply, a back ply, an interior space, an exterior surface, and an outer perimeter, wherein the interior space is sealed between the front ply and the back ply separate from the shooting target, wherein the receptacle is further comprised of a plurality of chambers, wherein a first set of the chambers has a cellular shape and is spaced inwardly from the outer perimeter of the receptacle, wherein a second set of the chambers is positioned adjacent to the outer perimeter of the receptacle, wherein at least the first set of chambers are arranged in a staggered geometric pattern, wherein the second set of chambers is selected from a group consisting of chambers having different shapes from the cellular shape and chambers forming a finished outer perimeter with a plurality of nonlinear sides, wherein the second set of chambers having different shapes from the cellular shape form the outer perimeter with a plurality of linear sides;

a fluid sealed within each one of the chambers in the interior space of the receptacle; and a fastener connected to the exterior surface of the receptacle's back ply.

9. The splatter pack of claim 8, further comprising a plurality of channels positioned between adjacent chambers in the first set of chambers and the second set of chambers, wherein each one of the chambers in the first set of chambers is intersected by at least one of the channels, and wherein there is no set of orthogonal straight lines that can extend in the channels between opposite sides of the outer perimeter without one of the orthogonal straight lines intersecting at least one of the chambers.

10. The splatter pack of claim 1, further comprising a target panel comprising a front surface and a back surface, wherein a portion of the front surface of the target panel is further comprised of a silhouette indicia having a first shape and an outline indicia having a second shape within the silhouette indicia, wherein the outer perimeter matches the second shape, wherein the fastener is further comprised of an adhesive layer affixed to at least a portion of the exterior surface of the receptacle's back ply, and wherein the fastener attaches the back ply of the receptacle to the front surface of the target panel.

11. The splatter pack of claim 10, wherein the fastener is further comprised of a film layer having a first position in contact with and covering the adhesive layer and a second position separated from and exposing the adhesive layer, wherein the adhesive layer attaches the receptacle's back ply to the shooting target when the film is in the second position.

12. The splatter pack of claim 10, wherein the fastener is further comprised of at least one of a magnet and a hook and loop fastener attached to the receptacle's back ply by the adhesive layer.

13. The splatter pack of claim 1, wherein the first set of chambers and the second set of chambers are arranged in a staggered geometric pattern, wherein the second set of chambers have the same whole shape as the cellular shape, and wherein each one of the nonlinear sides of the finished outer perimeter is further comprised of a repeating geometric shape corresponding with a segment of the cellular shape.

14. The splatter pack of claim 13, further comprising a plurality of channels positioned between adjacent chambers in the first set of chambers and the second set of chambers, wherein each one of the chambers in the first set of chambers is intersected by at least one of the channels, and wherein there is no set of orthogonal straight lines that can extend in the channels between opposite sides of the outer perimeter without one of the orthogonal straight lines intersecting at least one of the chambers.

15. A splatter pack for a shooting target, comprising:

a receptacle comprising a front ply, a back ply, an interior space, an exterior surface, and an outer perimeter, wherein the interior space is sealed between the front ply and the back ply separate from the shooting target, wherein the receptacle is further comprised of a plurality of chambers, wherein a first set of the chambers has a cellular shape and is spaced inwardly from the outer perimeter of the receptacle, wherein a second set of the chambers is positioned adjacent to the outer perimeter of the receptacle, and wherein the first set of chambers and the second set of chambers are arranged in a staggered geometric pattern;

a plurality of channels positioned between adjacent chambers in the first set of chambers and the second set of chambers, wherein each one of the chambers in the first set of chambers is intersected by at least one of the channels, and wherein there is no set of orthogonal straight lines that can extend in the channels between opposite sides of the outer perimeter without one of the orthogonal straight lines intersecting at least one of the chambers;

a fluid sealed within each one of the chambers in the interior space of the receptacle; and a fastener connected to the exterior surface of the receptacle's back ply.

16. The splatter pack of claim 15, wherein the geometric pattern of the first set of chambers is selected from the group of patterns consisting of serpentine chambers, honeycombed chambers, horizontal chambers, vertical chambers, and any combination thereof.

17. The splatter pack of claim 16, wherein each one of the chambers in the second set of chambers has a different shape from the cellular shape, wherein a first side of the second set of chambers proximal to the first set of chambers has a first shape matching the cellular shape, and wherein a second side of the second set of chambers proximal to the outer perimeter of the receptacle has a second shape matching a curved outline shape of the outer perimeter.

18. The splatter pack of claim 16, wherein the second set of chambers form a finished outer perimeter with a plurality of nonlinear sides.

19. A set of splatter packs for a shooting target, comprising:

a receptacle comprising a front ply, a back ply, an interior space, an exterior surface, and an outer perimeter, wherein the interior space is sealed between the front ply and the back ply separate from the shooting target, wherein the receptacle is further comprised of a plurality of chambers, wherein a first set of the chambers has a cellular shape and is spaced inwardly from the outer perimeter of the receptacle, wherein a second set of the chambers is positioned adjacent to the outer perimeter of the receptacle, wherein the second set of chambers is selected from a group consisting of chambers having different shapes from the cellular shape and chambers forming a finished outer perimeter with a plurality of nonlinear sides, and wherein the first set of chambers and the second set of chambers are arranged in a staggered geometric pattern;

a plurality of channels positioned between adjacent chambers in the first set of chambers and the second set of chambers, wherein each one of the chambers in the first set of chambers is intersected by at least one of the channels, and wherein there is no set of orthogonal straight lines that can extend in the channels between opposite sides of the outer perimeter without one of the orthogonal straight lines intersecting at least one of the chambers;

a fluid sealed within each one of the chambers in the interior space of the receptacle; and a fastener connected to the exterior surface of the receptacle's back ply.

20. The splatter pack of claim 19, wherein the nonlinear sides of the finished outer perimeter are further comprised of a curved outline shape with the second set of chambers having different shapes from the cellular shape, wherein the curved outline shape has at least one of a plurality of body part shapes selected from the group consisting of a lung, a heart, a brain, and a lung and heart combination.

21. The splatter pack of claim 19, wherein the second set of chambers have the same whole shape as the cellular shape, and wherein each one of the nonlinear sides of the finished outer perimeter is further comprised of a repeating geometric shape corresponding with a segment of the cellular shape.

22. The splatter pack of claim 19, wherein the second set of chambers having different shapes from the cellular shape form the outer perimeter with a plurality of linear sides.

* * * * *